US008653747B2

(12) United States Patent
Wang et al.

(10) Patent No.: US 8,653,747 B2
(45) Date of Patent: Feb. 18, 2014

(54) LIGHT EMITTING DEVICE AND DRIVING METHOD THEREOF

(75) Inventors: Ching-Hung Wang, Hsin-Chu (TW); Ching-Yi Chen, Hsin-Chu (TW); Sheng-Kai Hsu, Hsin-Chu (TW)

(73) Assignee: AU Optronics Corp., Science-Based Industrial Park, Hsin-Chu (TW)

( * ) Notice: Subject to any disclaimer, the term of this patent is extended or adjusted under 35 U.S.C. 154(b) by 512 days.

(21) Appl. No.: 13/048,855

(22) Filed: Mar. 15, 2011

(65) Prior Publication Data

US 2012/0032603 A1 Feb. 9, 2012

(30) Foreign Application Priority Data

Aug. 6, 2010 (TW) ..... 99126270 A

(51) Int. Cl.
*H05B 37/02* (2006.01)

(52) U.S. Cl.
USPC ..... 315/291; 315/307; 315/308

(58) Field of Classification Search
USPC ..... 315/185 R, 192, 209 R, 224–225, 291, 315/307, 308, 312, 318, 361
See application file for complete search history.

(56) References Cited

U.S. PATENT DOCUMENTS

| | | | | |
|---|---|---|---|---|
| 7,119,500 | B2 | 10/2006 | Young | |
| 7,550,934 | B1 * | 6/2009 | Deng et al. | 315/308 |
| 2004/0052076 | A1 | 3/2004 | Mueller | |
| 2007/0170876 | A1 | 7/2007 | Ito | |
| 2009/0174340 | A1 * | 7/2009 | Kumagai | 315/291 |
| 2010/0001663 | A1 | 1/2010 | Wu | |

FOREIGN PATENT DOCUMENTS

| | | |
|---|---|---|
| TW | 201004143 | 1/2010 |
| TW | 201008368 | 2/2010 |

* cited by examiner

*Primary Examiner* — Jimmy Vu
(74) *Attorney, Agent, or Firm* — Winston Hsu; Scott Margo

(57) ABSTRACT

A light emitting device includes a plurality of light emitting modules and a plurality of voltage controlling circuits capable of being independently controlled. Each voltage controlling circuit includes a dynamic voltage controlling module, a current controlling module, and a luminance controlling module. The dynamic voltage controlling module is used for comparing a voltage level at a second terminal of the light emitting module and a voltage level of a reference voltage source, so as to output a first voltage. The current controlling module is used for adjusting a bias current flowing through the light emitting module, according to the first voltage. The luminance controlling module is used for comparing the first voltage with a clock signal, and for generating a pulse width modulation signal according to a result of the comparison, so as to dynamically control a duty cycle of the light emitting module.

9 Claims, 5 Drawing Sheets

LIGHT EMITTING DEVICE AND DRIVING METHOD THEREOF

BACKGROUND OF THE INVENTION

1. Field of the Invention

The present invention is related to light emitting devices and related driving methods, and more particularly to a light emitting device and related method thereof that dynamically changes amplitude of a driving current driving a light emitting module for reducing unnecessary power consumption.

2. Description of the Prior Art

Please refer to FIG. 1, which is a diagram of a light emitting device 100. As shown in FIG. 1, the light emitting device 100 comprises a plurality of groups of light emitting modules LED1, LED2, LED3, LED4, and a light emitting module driver circuit 110. Each light emitting module comprises a plurality of series-connected light emitting units Pcs, and is coupled to a voltage source VLED for receiving needed driving current. The light emitting units Pcs are generally realized as light emitting diodes (LEDs). The light emitting module driver circuit 110 has a plurality of driving terminals CH1, CH2, CH3, CH4 for receiving voltages VFB1, VFB2, VFB3, VFB4 through the light emitting modules LED1, LED2, LED3, LED4, respectively, for generating corresponding driving currents for driving the light emitting modules LED1, LED2, LED3, LED4. Voltage at each driving terminal CH1, CH2, CH3, CH4 is the corresponding voltage VFB1, VFB2, VFB3, VFB4.

Due to process variation, the light emitting units Pcs comprised by the light emitting modules LED1-LED4 each generate different bias voltage errors, which leads to higher voltages being generated at some driving terminals corresponding to light emitting modules having lower overall bias error, and further causes wasted power consumption in the light emitting module driver circuit 110. Taking FIG. 1 as an example, assuming voltage level of the voltage source VLED is 14.1 Volts, each light emitting unit Pcs of the light emitting module LED1 has a bias voltage error of 3.1 Volts, each light emitting unit Pcs of the light emitting module LED2 has a bias voltage error of 3.2 Volts, each light emitting unit Pcs of the light emitting module LED3 has a bias voltage error of 3.3 Volts, and each light emitting unit Pcs of the light emitting module LED4 has a bias voltage error of 3.4 Volts, the voltage VFB1 becomes 14.1−3.1×4=1.7 Volts, the voltage VFB2 becomes 14.1−3.2×4=1.3 Volts, the voltage VFB3 becomes 14.1−3.3×4=0.9 Volts, and the voltage VFB4 becomes 14.1−3.4×4=0.5 Volts. If driving currents of the light emitting modules LED1-LED4 have the same amplitude, and the light emitting module driver circuit 110 only needs 0.5 Volts to operate correctly, the light emitting module driver circuit 110 wastes power at the driving terminals CH1, CH2, CH3.

One typical solution for improving on the waste of power described above involves adding pins on the plurality of light emitting units comprised by the light emitting module for connecting to the light emitting module driver circuit 110 to keep the voltages VFB1-VFB4 at approximately 0.5 Volts. However, not only are additional pins required in design of the light emitting module driver circuit 110 which increases manufacturing costs of each light emitting module and the light emitting module driver circuit, but circuit design is also complicated.

SUMMARY OF THE INVENTION

According to an embodiment, a light emitting device coupled to a voltage source comprises a plurality of light emitting modules, and a plurality of voltage controlling circuits. The voltage controlling circuits are independently controlled, and each voltage controlling circuit is coupled to a group of corresponding light emitting modules of the plurality of light emitting modules having a first terminal coupled to the voltage source. The voltage controlling circuit comprises a dynamic voltage controlling module, a current controlling module, and a luminance controlling module. The dynamic voltage controlling module comprises a first input terminal coupled to a second terminal of the group of corresponding light emitting modules, and a second input terminal for receiving a reference voltage. The dynamic voltage controlling module compares voltage level at the second terminal of the group with the reference voltage for outputting a first voltage. The current controlling module is coupled to the dynamic voltage controlling module for adjusting bias current flowing through the group of corresponding light emitting modules according to the first voltage. The luminance controlling module is coupled to the dynamic voltage controlling module for comparing the first voltage with a clock signal, and generating a pulse width modulation (PWM) signal according to a result of the comparison for dynamically controlling a duty cycle of the group of corresponding light emitting modules.

These and other objectives of the present invention will no doubt become obvious to those of ordinary skill in the art after reading the following detailed description of the preferred embodiment that is illustrated in the various figures and drawings.

DETAILED DESCRIPTION

To improve on the problem of wasted power found in the light emitting device 100 described above, a light emitting device that changes amplitude of driving current driving a light emitting module to lower bias of a light emitting module driver circuit, and thereby reduce wasted power, is described in the multiple embodiments.

Figure 2:
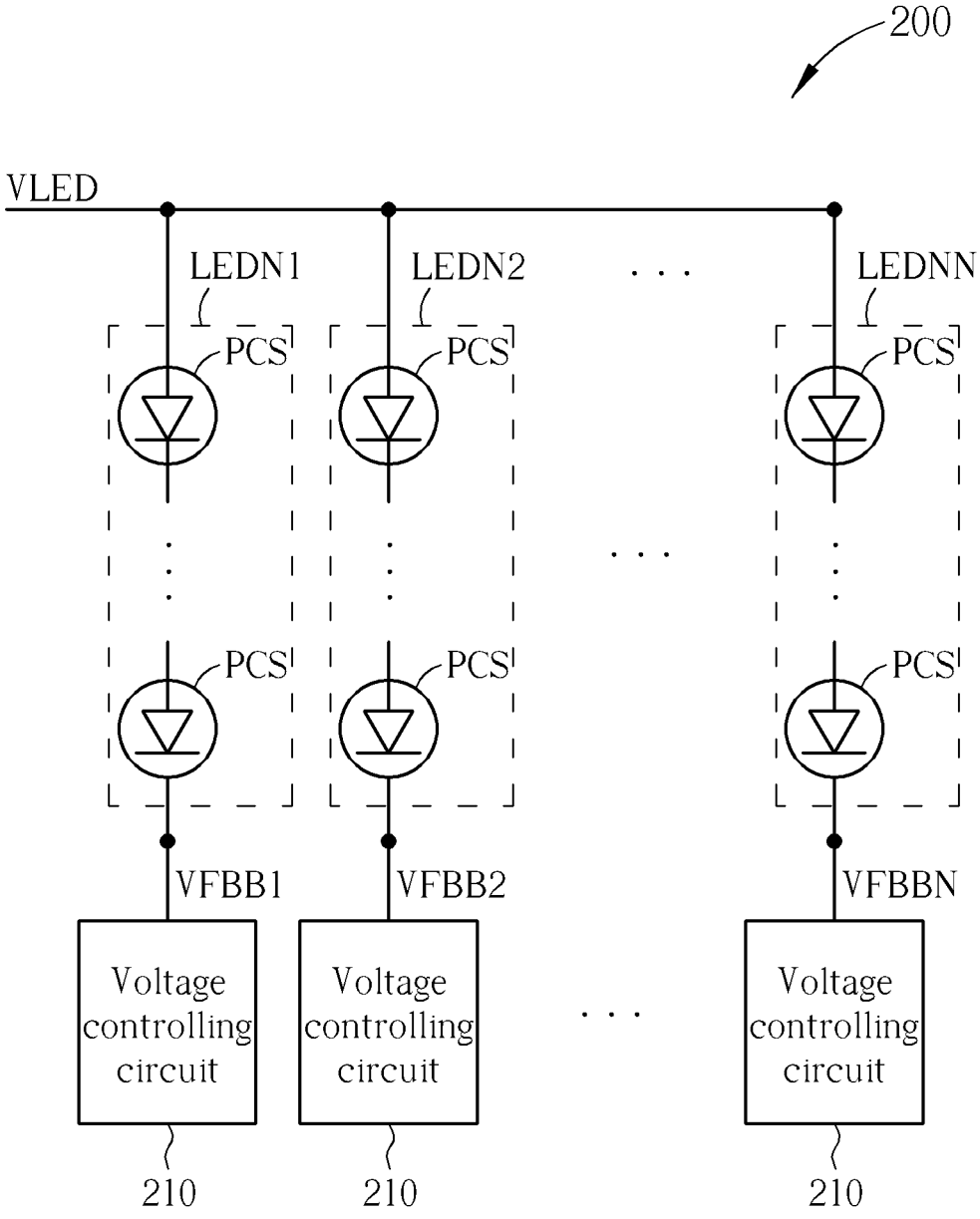
FIG. 2 is a diagram of a light emitting device according to one embodiment.

Please refer to FIG. 2, which is a diagram of a light emitting device 200 according to one embodiment. As shown in FIG. 2, the light emitting device 200 comprises a plurality of light emitting modules LEDN1, LEDN2, . . . , LEDNN. Each light emitting module LEDN1-LEDNN comprises a plurality of series-connected light emitting units Pcs, has a first terminal coupled to a voltage source VLED, and has a second terminal coupled to an independently controllable voltage controlling circuit 210. The second terminals of the light emitting modules LEDN1, LEDN2, . . . , LEDNN are at voltages VFBB1, VFBB2, . . . , VFBBN, respectively.

Figure 3:
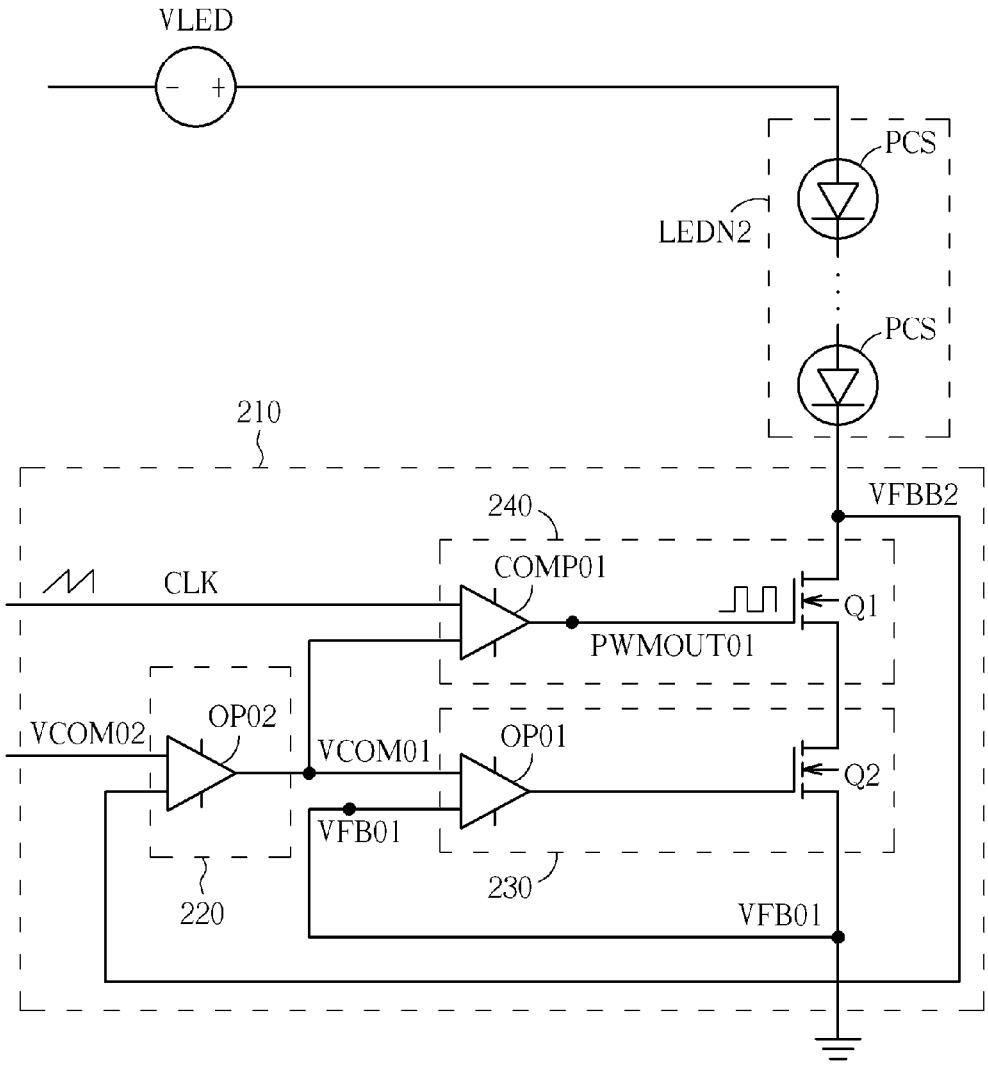
FIG. 3 is a diagram of the voltage controlling circuit shown in FIG. 2.

Please refer to FIG. 3, which is a diagram of the voltage controlling circuit 210 shown in FIG. 2. The voltage controlling circuit 210 coupled to the light emitting module LEDN2 is shown in FIG. 3 for illustrative purposes. Structure and functions of all voltage controlling circuits 210 shown in FIG. 2 are the same as shown in FIG. 3. As shown in FIG. 3, the voltage controlling circuit 210 comprises a dynamic voltage controlling module 220, a current controlling module 230, and a luminance controlling module 240.

The dynamic voltage controlling module 220 comprises an operational amplifier OP02. The dynamic voltage controlling module 220 is utilized for receiving voltage provided by the voltage source VLED through the light emitting module LEDN2 (namely, the voltage VFBB2 shown in FIG. 3). A first input terminal of the operational amplifier OP02 is coupled to a terminal of a light emitting unit Pcs of the light emitting module LEDN2 for receiving the voltage VFBB2. A second input terminal of the operation amplifier OP02 is coupled to a reference voltage VCOM02. The operational amplifier OP02 is utilized for comparing the voltage VFBB2 with the reference voltage VCOM02, and outputting voltage VCOM01.

The current controlling module 230 comprises an operational amplifier OP01 and a transistor Q2, and is coupled to the dynamic voltage controlling module 220. The current controlling module 230 is utilized for adjusting amplitude of bias current flowing through the light emitting module LEDN2 according to the voltage VFBB2 generated by the dynamic voltage controlling module 220. A first terminal of the transistor Q2 is coupled to the light emitting module LEDN2, and a second terminal of the transistor Q2 is grounded. Voltage at the second terminal of the transistor Q2 is voltage VFB01. A first input terminal of the operational amplifier OP01 is coupled to the second terminal of the transistor Q2 for receiving the voltage VFB01. A second input terminal of the operational amplifier OP01 is coupled to an output terminal of the operational amplifier OP02 for receiving the voltage VCOM01. An output terminal of the operational amplifier OP02 is coupled to a control terminal of the transistor Q2 for controlling bias voltage of the transistor Q2, such that the transistor Q2 may adjust amplitude of bias current flowing through the light emitting module LEDN2 according to the bias voltage.

The luminance controlling module 240 comprises an operational amplifier COMP01 and a transistor Q1. The luminance controlling module 240 is coupled to the current controlling module 230 for comparing the voltage VCOM01 with a clock signal CLK (triangle wave), and generating a pulse width modulation (PWM) signal according to the comparison result. The PWM signal PWMOUT01 is outputted to the dynamic voltage controlling module 220 for the dynamic voltage controlling module 220 to control duty cycle of the light emitting module LEDN2 according to the PWM signal PWMOUT01. A first terminal of the transistor Q1 is coupled to the light emitting module for receiving the voltage VFBB2 corresponding to the voltage source VLED, and a second terminal of the transistor Q1 is coupled to the first terminal of the transistor Q2. A first input terminal of the operational amplifier COMP01 is coupled to the dynamic voltage controlling circuit 220 for receiving the voltage VCOM01. A second input terminal of the operational amplifier COMP01 is utilized for receiving the clock signal CLK. An output terminal of the operational amplifier is coupled to a control terminal of the transistor Q1 for outputting the PWM signal PWMOUT01 for controlling the duty cycle of the transistor Q1 for dynamically controlling duty cycle and luminance of the light emitting module LEDN2.

Detailed operation of the voltage controlling circuit 210 shown in FIG. 3 is described in the following. When the voltage controlling circuit 210 receives the voltage VFBB2 through the light emitting module LEDN2, the dynamic voltage controlling module 220 compares the voltage VFBB2 with the reference voltage VCOM02. The reference voltage VCOM02 is typically common voltage used on a liquid crystal display panel. Thus, the voltage VCOM01 corresponds to voltage difference between the voltage VFBB2 currently used to drive the light emitting module LEDN2 and the common voltage of the liquid crystal display panel.

The operational amplifier OP01 and the transistor Q2 form a closed feedback loop for gradually pulling the voltage level of the voltage VFB01 to the voltage level of the voltage VCOM01, and, under the condition that the transistor Q2 operates in the saturation region, controlling the gate-source voltage of the transistor Q2 (namely, the bias voltage of the transistor Q2), thereby controlling amplitude of the bias current of the transistor Q2 according to the gate-source voltage. Amplitude of the bias current of the transistor Q2 is continually adjusted relative to the voltage VCOM01, so as to stabilize the amplitude of the bias current. It can be seen from FIG. 3 that the bias current of the transistor Q2 also flows through the light emitting module LEDN2. Thus, the amplitude of the bias current of the transistor Q2 is held stable, which is equivalent to holding the bias current of the light emitting module LEDN2 stable, preventing large changes in the amplitude of the bias current from damaging the light emitting units Pcs comprised by the light emitting module LEDN2.

Figure 1:
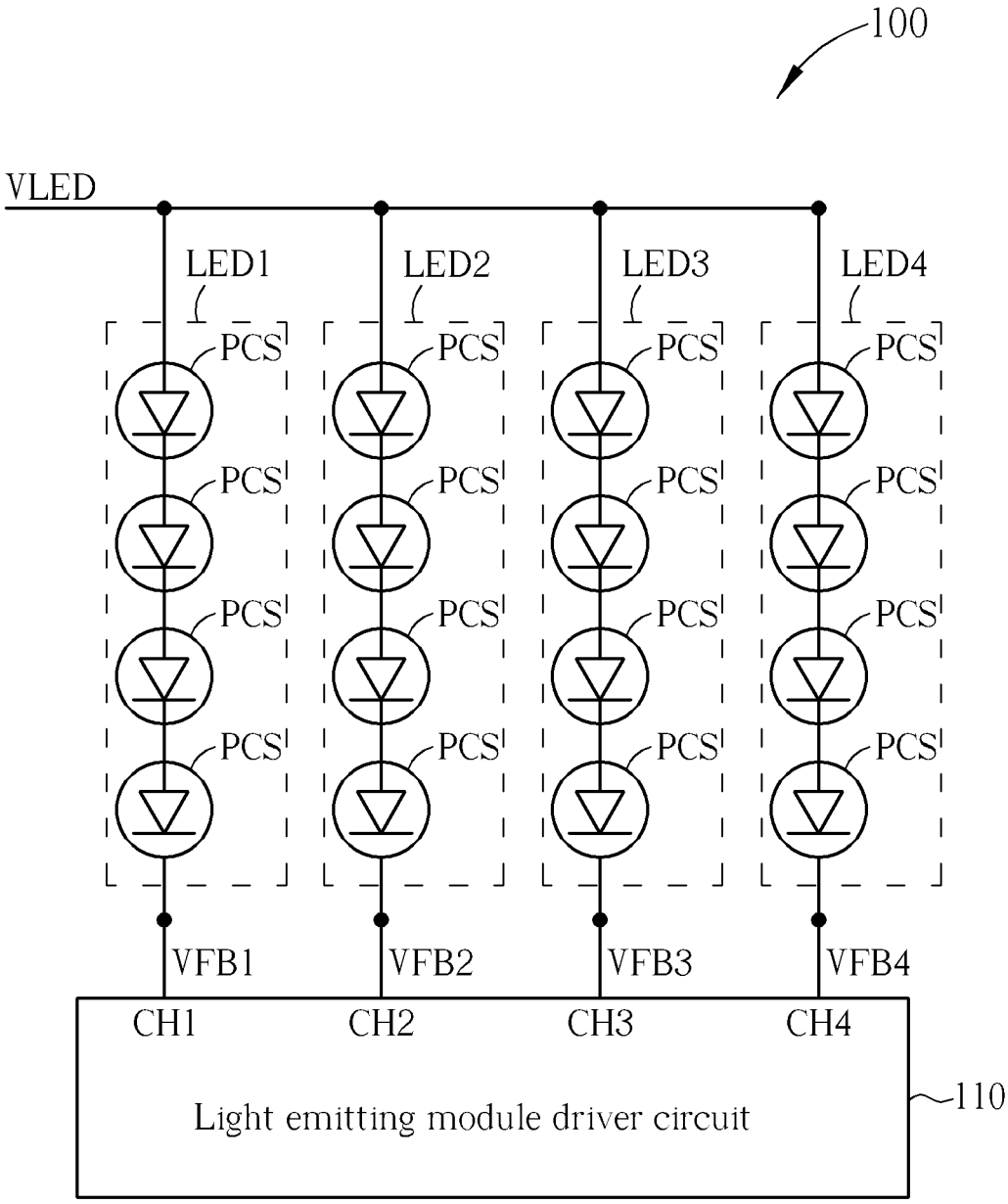
FIG. 1 PRIOR ART
FIG. 1 is a diagram of a light emitting device.

In the luminance controlling module 240, the operational amplifier COMP01 generates the PWM signal PWMOUT01 according to the voltage VCOM01 and the clock signal CLK. The duty cycle of the PWM signal PWMOUT01 is adjusted dynamically with increases/decreases in the voltage VCOM01. The duty cycle of the transistor Q1 is also adjusted dynamically with the duty cycle of PWM signal PWMOUT01. Because luminance of the light emitting units Pcs comprised by the light emitting module LEDN2 is related to the duty cycle of the transistor Q1, luminance of each light emitting unit Pcs is also adjusted accordingly, without producing overly bright or dim luminance. The voltage level of the voltage VFBB2 is also adjusted because the duty cycle of the transistor Q1 is dynamically controlled by the PWM signal PWMOUT01. Thus, the dynamic voltage controlling module 220 equivalently receives feedback adjustment voltage of the voltage VFBB2 through the luminance controlling module 240, thereby achieving dynamic control of amplitude of the voltage VFBB2, and avoiding the problem shown in FIG. 1 of the voltages VFB1, VFB2, VFB3 being too high leading to excess power consumption.

Figure 4:
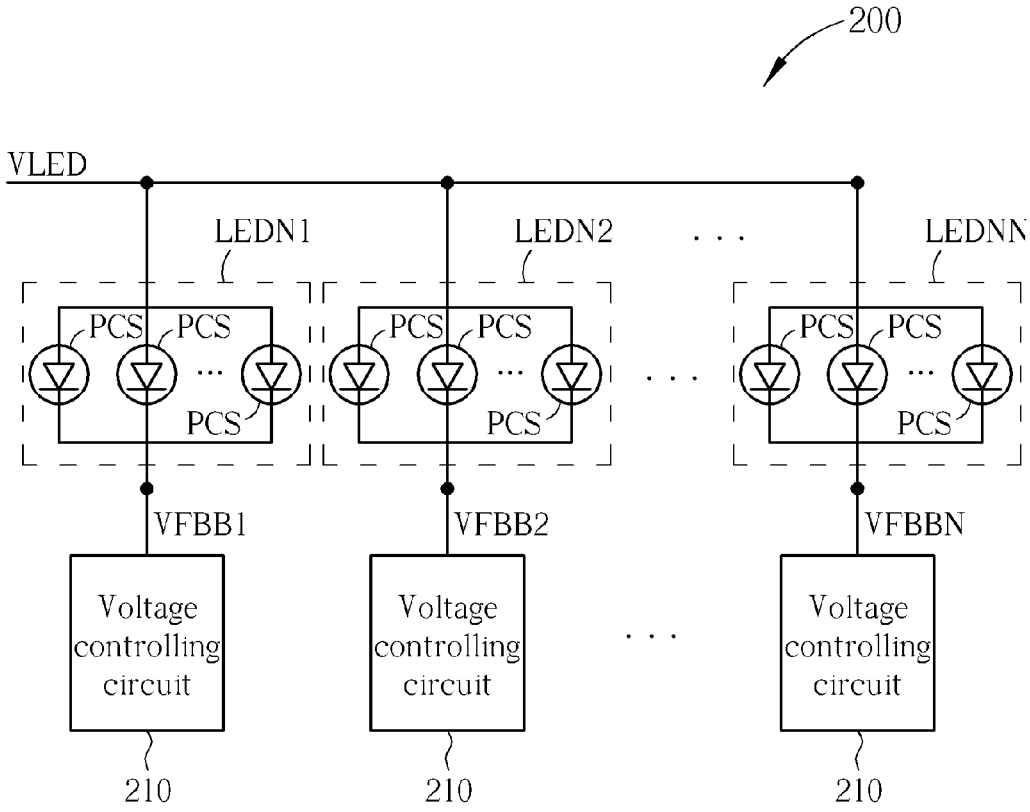
FIG. 4 is a diagram of the light emitting device shown in FIG. 2 according to another embodiment.

Please refer to FIG. 4, which is a diagram of the light emitting device 200 shown in FIG. 2 according to another embodiment. The light emitting device 200 shown in FIG. 4 is different from the light emitting device 200 shown in FIG. 2 in that the light emitting units Pcs of the light emitting modules LEDN1-LEDNN are parallel-connected in the embodiment shown in FIG. 4, whereas the light emitting units Pcs are series-connected in FIG. 2.

Figure 5:
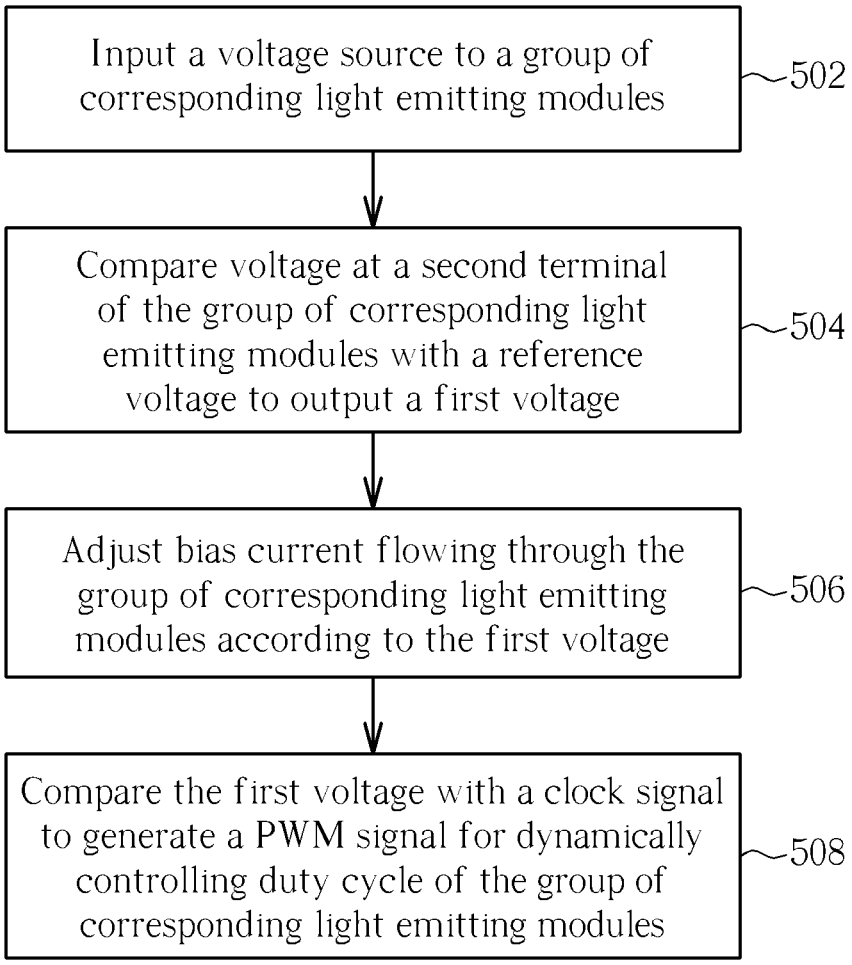
FIG. 5 is a flowchart of a method of driving the light emitting device shown in FIG. 2 and FIG. 3.

Please refer to FIG. 5, which is a flowchart of a method of driving the light emitting device 200 shown in FIG. 2 and FIG. 3. As shown in FIG. 5, the method comprises the following steps:

Step 502: Input a voltage source to a group of corresponding light emitting modules;

Step 504: Compare voltage at a second terminal of the group of corresponding light emitting modules with a reference voltage to output a first voltage;

Step 506: Adjust bias current flowing through the group of corresponding light emitting modules according to the first voltage; and Step 508: Compare the first voltage with a clock signal to generate a PWM signal for dynamically controlling duty cycle of the group of corresponding light emitting modules.

Step 502 describes the condition shown in FIG. 3 wherein the light emitting module LEDN2 receives voltage of the voltage source VLED and generates the voltage VFBB2. Step 504 describes the process of the operational amplifier OP02 of the dynamic voltage controlling module 220 comparing the voltage VFBB2 with the reference voltage VCOM02 to generate the voltage VCOM01. Step 506 describes the current controlling module 230 adjusting the bias voltage of the transistor Q2 according to the voltage VCOM01 for adjusting the amplitude of the bias current of the light emitting module LEDN2. Step 508 describes the operational amplifier COMP01 of the luminance controlling module 240 comparing the clock signal CLK with the voltage VCOM01 to generate the PWM signal PWMCOM01 and thereby controlling the duty cycle of the transistor Q1 for dynamically controlling the duty cycle and luminance of the light emitting module LEDN2.

Please note that embodiments obtained by reordering the steps of FIG. 5, or adding functions described above thereto, should be considered embodiments of the present invention.

The embodiments describe a light emitting device that dynamically adjusts driving current flowing through a light emitting module thereof, and related method. By stabilizing the driving current that flows through each light emitting module of the light emitting device by dynamically changing its amplitude, each light emitting module and its independently operating voltage controlling circuit may have similar voltage levels, thereby reducing the excess power consumption caused by light emitting modules of conventional light emitting devices having different bias voltages.

Those skilled in the art will readily observe that numerous modifications and alterations of the device and method may be made while retaining the teachings of the invention.

What is claimed is:

1. A light emitting device coupled to a voltage source, the light emitting device comprising:

a plurality of light emitting modules; and a plurality of voltage controlling circuits that are independently controlled, each voltage controlling circuit coupled to a group of corresponding light emitting modules of the plurality of light emitting modules, the group having a first terminal coupled to the voltage source, the voltage controlling circuit comprising:

a dynamic voltage controlling module comprising a first input terminal coupled to a second terminal of the group of corresponding light emitting modules, and a second input terminal for receiving a reference voltage, the dynamic voltage controlling module comparing voltage level at the second terminal of the group with the reference voltage for outputting a first voltage;

a current controlling module coupled to the dynamic voltage controlling module for adjusting a bias current flowing through the group of corresponding light emitting modules according to the first voltage; and a luminance controlling module coupled to the dynamic voltage controlling module for comparing the first voltage with a clock signal, and generating a pulse width modulation (PWM) signal according to a result of the comparison for dynamically controlling a duty cycle of the group of corresponding light emitting modules.

2. The light emitting device of claim 1, wherein the dynamic voltage controlling module comprises:

a first operational amplifier having a first input terminal coupled to the second terminal of the group of corresponding light emitting modules, a second input terminal for receiving the reference voltage, and an output terminal for outputting the first voltage.

3. The light emitting device of claim 2, wherein the current controlling module comprises:

a first transistor having a first terminal coupled to the second terminal of the group of corresponding light emitting modules, and a second terminal coupled to ground; and a second operational amplifier having a first input terminal coupled to the second terminal of the first transistor, a second input terminal coupled to the output terminal of the first operational amplifier for receiving the first voltage, and an output terminal coupled to a control terminal of the first transistor for controlling bias voltage of the first transistor for adjusting the bias current flowing through the group of corresponding light emitting modules.

4. The light emitting device of claim 3, wherein the luminance controlling module comprises:

a second transistor having a first terminal coupled to the second terminal of the group of corresponding light emitting modules, and a second terminal coupled to the first terminal of the first transistor; and a third operational amplifier having a first input terminal coupled to the output terminal of the first operational amplifier for receiving the first voltage, a second input terminal for receiving the clock signal, and an output terminal coupled to a control terminal of the second transistor for outputting the PWM signal for controlling the duty cycle of the second transistor through the PWM signal.

5. The light emitting device of claim 1, wherein the group of corresponding light emitting modules comprises at least one light emitting module.

6. The light emitting device of claim 5, wherein the light emitting module is a light emitting diode (LED).

7. The light emitting device of claim 5, wherein the at least one light emitting module are coupled in series.

8. The light emitting device of claim 5, wherein the at least one light emitting module are coupled in parallel.

9. A method of driving the light emitting device of claim 1, the method comprising:

inputting the voltage source to the group of corresponding light emitting modules;

comparing voltage level at the second terminal of the group of corresponding light emitting modules with the reference voltage, and outputting the first voltage according to a result of the comparison;

adjusting the bias current flowing through the group of corresponding light emitting modules according to the first voltage; and comparing the first voltage with the clock signal to generate the PWM signal for dynamically controlling the duty cycle of the group of corresponding light emitting modules.

* * * * *